US006122386A

United States Patent [19]

Wiley

[11] Patent Number: 6,122,386

[45] Date of Patent: Sep. 19, 2000

[54] ADJUSTABLE SPEAKER SYSTEM WITH REFLECTOR

[75] Inventor: Robert John Wiley, Wichita, Kans.

[73] Assignee: Music Industries Corp., Floral Park, N.Y.

[21] Appl. No.: 09/299,973

[22] Filed: Apr. 26, 1999

[51] Int. Cl.[7] ..... H04R 25/00

[52] U.S. Cl. ..... 381/160; 381/337; 181/155; 181/175

[58] Field of Search ..... 381/160, 337; 181/155, 175, FOR 139, 140, 145

[56] References Cited

U.S. PATENT DOCUMENTS

| | | | |
|---|---|---|---|
| 3,964,571 | 6/1976 | Snell . | |
| 4,322,578 | 3/1982 | Selmin . | |
| 4,625,829 | 12/1986 | Sirois | 181/175 |
| 4,701,951 | 10/1987 | Kash | 381/160 |
| 5,031,220 | 7/1991 | Takagi et al. . | |
| 5,446,792 | 8/1995 | Sango . | |
| 5,485,521 | 1/1996 | Yagisawa et al. | 381/24 |

OTHER PUBLICATIONS

Excerpt, The New York Times, "This Piano Flips Some Lids" by Anthony Tommasini "no date provided".

*Primary Examiner*—Curtis A. Kuntz
*Assistant Examiner*—Phylesha Dabney
*Attorney, Agent, or Firm*—Amster, Rothstein & Ebenstein

[57] ABSTRACT

An adjustable speaker system includes a speaker enclosure having at least a forward facing surface, the speaker enclosure enclosing a speaker with a forward facing acoustic outlet from which sound may emanate in a forward direction. The system further includes at least one reflector, and preferably a pair of independently adjustable reflectors, with a sound-reflecting rearward facing surface, each reflector being pivotably secured adjacent the acoustic outlet and pivotable relative to the acoustic outlet between a non-reflecting orientation wherein the sound-reflecting rearward facing surface is substantially in alignment with the forward direction, thereby to only minimally reflect sound emanating from the acoustic outlet, and a reflecting orientation wherein the sound-reflecting rearward facing surface is substantially angled to the forward direction, thereby reflecting impinging sound emanating from the acoustic outlet laterally to a respective side.

11 Claims, 4 Drawing Sheets

FIG. 2
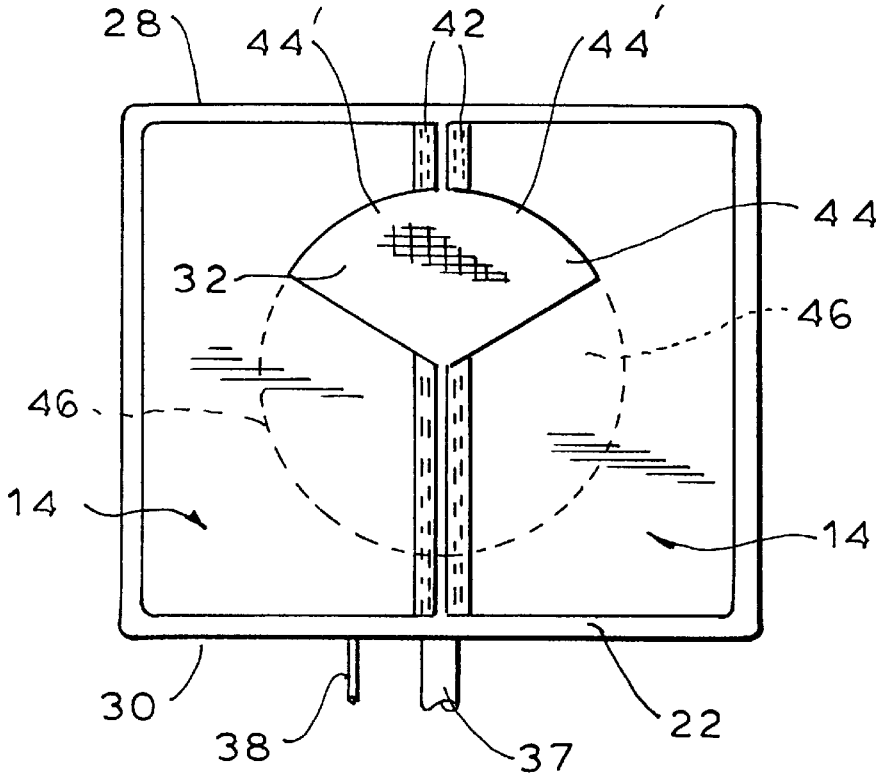
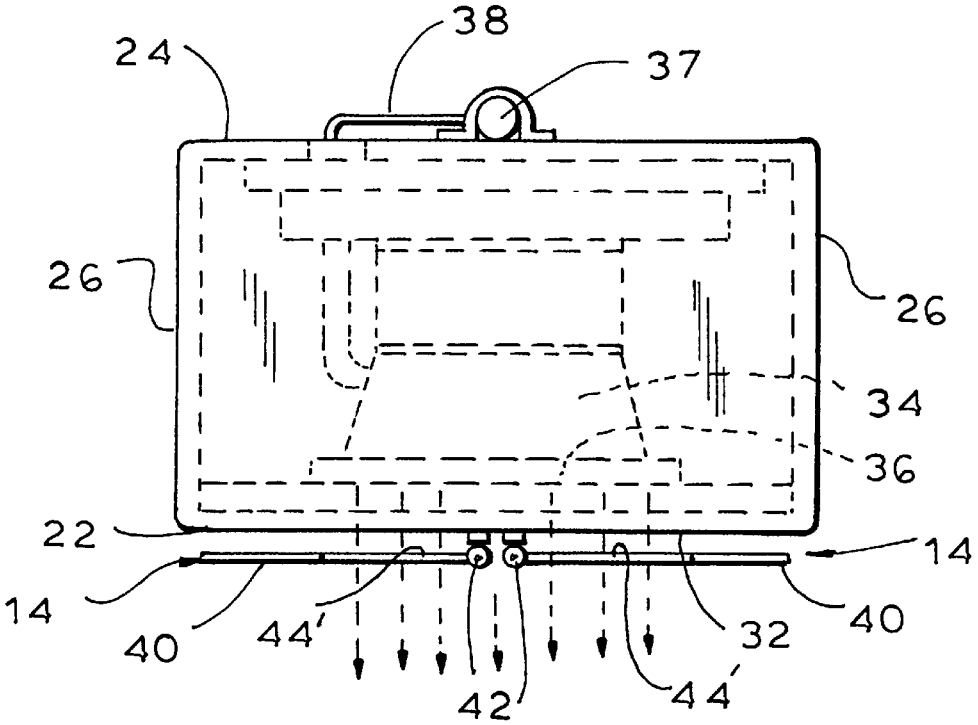
FIG. 3

ADJUSTABLE SPEAKER SYSTEM WITH REFLECTOR

BACKGROUND OF THE INVENTION

The present invention relates to a speaker system including at least one reflector for adjusting the directional characteristics of the speaker to increase the dispersion of sound at the higher frequencies and, more particularly, a system which has a pair of such reflectors.

A typical speaker system incorporates a moving element that translates electronic signals received from an amplification source into sound pressure waves by moving air with a diaphragm or like moving element that vibrates in sympathy with the incoming signals. As all musical sounds and speech is made up of varying frequencies, this translation of the electronic signals into the movement of air must also occur at varying frequencies. As the frequency produced increases, the sound that is produced by the speaker becomes more and more directional in nature; at frequencies above 250 Hz, this directional phenomena becomes noticeable. Indeed, most tweeters are so directional that the sound produced at these frequencies (above 4,000 Hz) is lost at anything more than 15° off the central axis perpendicular to the front of the tweeter (that is, the sound is limited to a 30° field). The higher frequencies are produced more and more in a plane that is 90 degrees (i.e., transverse or perpendicular) to the vibrating plane of the moving element or diaphragm of the speaker.

To help improve this limited dispersion at the higher frequencies, most speakers have a domed or conical shaped moving element. However, the movement imparted to this dome is still in a plane that is 90 degrees form the surface plane of the speaker. In the case of horn-type speakers, most horns have a very large flare starting from the moving element and expanding to the opening of the horn. This flare is, however, quite deceptive in that high frequencies will not follow a curve. As a rule of thumb, in order to hear the higher frequencies produced by a horn-type speaker, one must be able to actually see the moving element.

Typically dispersion becomes more and more narrow with higher frequencies. A problem arises in that the listener must be located within this narrow dispersion area or "sweet spot" in order to hear the complete content of the sound being produced. If not located within this "sweet spot", higher frequencies (those above 250 Hz) become muffled, and very high frequencies (those above 4,000 Hz such as cymbals, or sibilants such as the sss and ttt sounds, and the overtones of all musical instruments) are lost to the listener. For this reason, most concerts are performed with the system in mono or monaural condition, where the same sound emanates from speakers placed to the left and right of the performance area. If a stereo performance were desired, only those listeners who were equally within the "sweet spot" of both the left and right speakers, would benefit. For most, the sound coming out of the left speakers would be a mystery to those on the right, and vice versa. The conventional solution is to use many mid and high frequency speakers, pointed in multiple directions, in order to allow the entire audience enjoy full fidelity from both left and right outputs. This is extremely expensive to achieve, and frequently it is not possible or economical for the average performing environment. Thus, the need remains for a practical and economical way to enlarge this "sweet spot" so as to allow everyone to enjoy full fidelity sound regardless of their position.

U.S. Pat. No. 4,701,951 discloses an improved stereophonic imaging system with two stand-alone cabinet units.

Sound baffles are symmetrically arranged about a common vertical plane to emit directly radiated sounds while individual panels with cylindrical, convex reflecting surfaces are disposed with axes parallel to the common plane at variable distances from, and at variable angular orientations to, the common vertical plane, thereby to redirect energy emanating from the transducers as reflected secondary sound. The reflected sound blends together with the directly radiated sound to provide a coherent central image with improved definition and fidelity. The stereophonic system requires at least two stand-alone cabinet units or speaker enclosures rather than just one. Additionally, the reflecting surfaces reflect the sound only inwardly towards the common plane between the cabinet units (i.e., towards the other cabinet unit) rather than outwardly to both lateral sides of each cabinet unit. As a result, the "sweet spot" is necessarily relatively narrow.

Accordingly, it is an object of the present invention to provide an adjustable speaker system.

Another object is to provide such a speaker system which incorporates an adjustable reflector to reflect impinging sound.

A further object is to provide such a system with two independently adjustable reflectors wherein the adjustable reflectors redirect impinging sound laterally to both respective sides.

It is another object of the present invention to provide such a system which is inexpensive to manufacture, use and maintain.

SUMMARY OF THE INVENTION

It is now been found that the above and related objects of the present invention are obtained in an adjustable speaker system having a speaker enclosure and at least one reflector (and preferable a pair of reflectors). The speaker enclosure has at least a forward facing surface, and encloses a speaker with a forward facing acoustic outlet from which sound may emanate in a forward direction. The at least one reflector has a sound-reflecting rearward facing surface, each reflector being pivotably secured adjacent the forward facing acoustic outlet and pivotable relative to the forward facing acoustic outlet. It is pivotable between a non-reflecting orientation, wherein the sound-reflecting rearward facing surface is substantially in alignment with said forward direction, thereby to only minimally reflect sound emanating from said forward facing acoustic outlet, and a reflecting orientation, wherein the sound-reflecting rearward facing surface is substantially angled to the forward direction, thereby to reflect impinging sound emanating from the forward facing acoustic outlet laterally to a respective side.

In a preferred embodiment, the reflector is also pivotable relative to the forward facing acoustic outlet to and from a blocking orientation wherein the sound-reflecting rearward facing surface is generally parallel to the acoustic outlet, thereby to impede sound emanating from an area of the acoustic outlet therebehind. In the reflecting orientation, the sound-reflecting rearward facing surface is angled outwardly to the forward direction, thereby to reflect impinging sound emanating from the forward facing acoustic outlet laterally to a respective side. The system reflector is preferably pivotably secured forwardly of the forward facing acoustic outlet for pivoting about a central vertical axis substantially through the center of the acoustic outlet.

Preferably the pair of reflectors, when parallel to the forward facing acoustic outlet, cooperatively define (a) a sound-transmitting top portion extending about 120° bilaterally of a central vertical axis substantially through the center of the acoustic outlet over about the top third of the reflectors, and (b) two sound-reflecting bottom portions, each bottom portion extending about 120° on a respective side of the central axis over about a respective bottom two-thirds of the reflector. The reflector top portion is substantially disposed higher than the reflector bottom portions and is generally pie-shaped. The reflector portions are of generally equal area, the bottom reflector portions being left and right bottom reflector portions, and the left and right bottom reflector portions reflecting impinging sound towards the left and right, respectively, of the acoustic outlet. Preferably the system reflectors are independently pivotable.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 2 is a front elevational view of a speaker with the reflectors in the non-reflecting orientation; and FIG. 3 is a top plan view thereof;

DETAILED DESCRIPTION OF THE PREFERRED EMBODIMENTS

Figure 1:
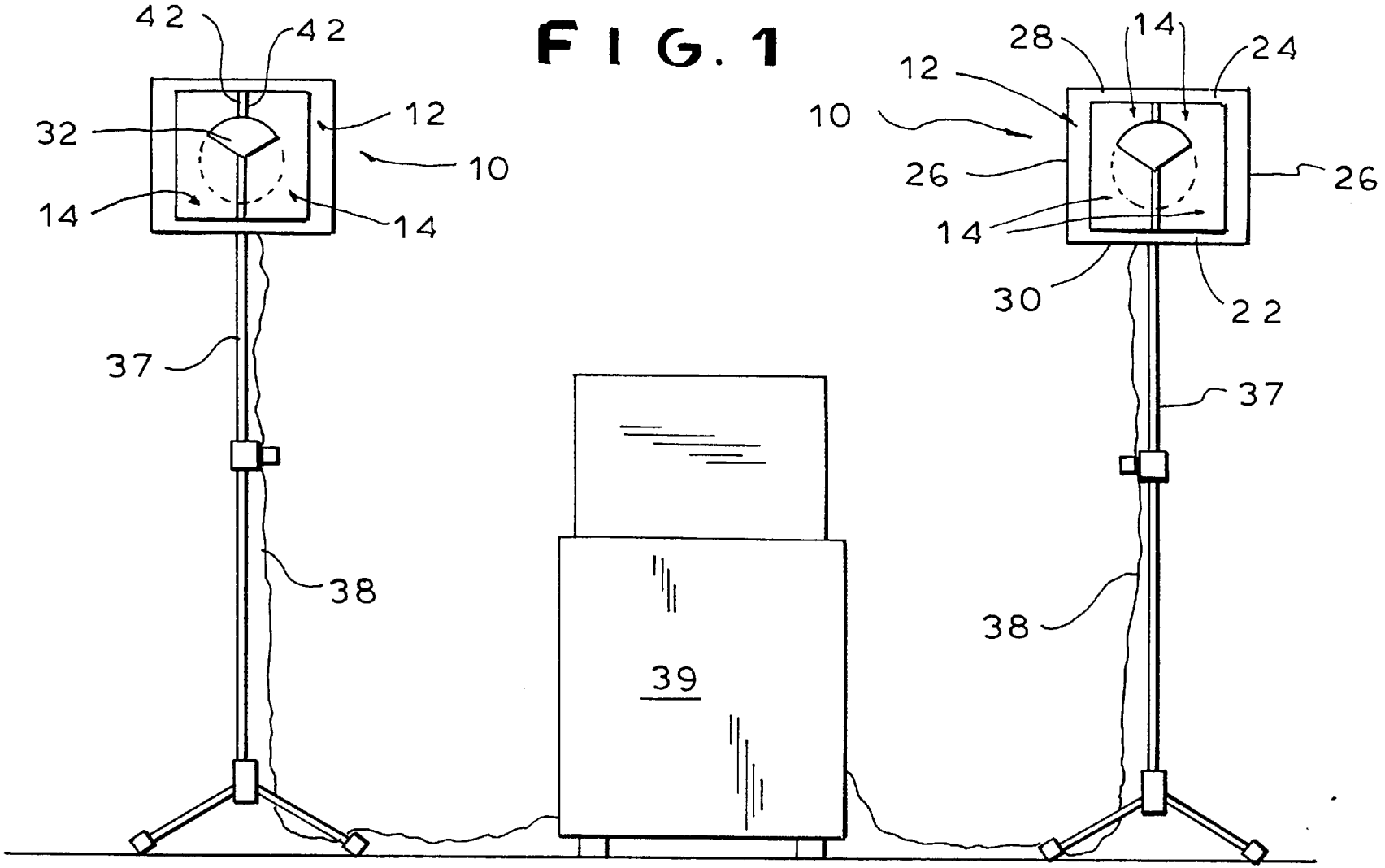
FIG. 1 is a front elevational view of a two-speaker system according to the present invention.

Referring now to the drawing, and in particular to FIG. 1 thereof, therein illustrated is an adjustable speaker system according to the present invention, generally designated by the reference numeral 10. The speaker system 10 comprises a speaker enclosure generally designated 12, and at least one reflector, generally designated 14.

The speaker enclosure 12 is of conventional design and thus may be of hollow parallelopiped design having a front 22, a back 24, a horizontally spaced pair of lateral sides 26, and a vertically spaced top 28 and bottom 30. The front 22 defines a preferably sound-transparent forward facing surface 32, which is typically a mesh or like sound-transmissive material. The speaker enclosure 12 encloses a conventional speaker 34 with a forward facing acoustic outlet 36 from which sound may emanate in a forward direction. The speaker 34 optionally includes a horn-type configuration (not shown) which conducts sound from the moving element of the speaker into the forward facing acoustic outlet 36. As the speaker enclosure 12 may be of conventional design and houses a speaker 34 of conventional design, further details thereof need not be recited herein.

It will be appreciated that where stereophonic sound is to be produced, typically at least two such speaker systems 10 will be provided.

More particularly, FIG. 1 illustrates a two-speaker system wherein each speaker enclosure 12 is mounted on an adjustable height vertical member 37 so as to be disposed at an appropriate height and connected by electrical wires 38 to an amplifier system 39.

Referring now to FIGS. 2–7, in its novel aspects the speaker system 10 additionally includes at least one reflector 14, and preferably a pair of reflectors 14. Each reflector 14 is provided with a sound-reflecting rearward facing surface 40 which is adapted to reflect sound impinging thereon. The sound-reflecting surface 40 is preferably planar and occupies a segment of a semi-circle, although other geometric forms may be used and, indeed, the sound-reflecting surface may occupy all of the rearward facing surface 40 of the reflector, except as noted hereinbelow.

Each reflector 14 is pivotably secured to the speaker enclosure 12 adjacent the forward facing acoustic outlet 36. Both reflectors 14 may share a common vertical pivot axis, but, as illustrated, preferably there are a closely horizontally spaced pair of vertical pivot axes 42, and each reflector 14 has its own axis 42. Each reflector 14 is pivotably secured at or closely forwardly of the forward facing acoustic outlet 36 for effectively pivoting about a respective central vertical pivot axis 42 substantially through or adjacent the center of the forward facing acoustic outlet 36. Preferably there are a closely horizontally spaced pair of vertical pivot axes 42 such that each reflector 14 is pivotable about its own vertical pivot axis so that there may be some horizontal separation between the two reflectors 14 even when the reflectors 14 are substantially in alignment with the forward direction (that is, forming a narrow "V" shape). Thus even when the sound-reflecting surfaces 40 are substantially in alignment with the forward direction so as to provide the "acoustic lens" effect described hereinafter, there is also a direct forward projection of the sound emanating from the acoustic outlet 36 between the two reflectors 14. Accordingly, what is referred to hereinafter as the narrow "V" shape is in reality a narrow "V" which has been truncated at the apex.

Figure 4:
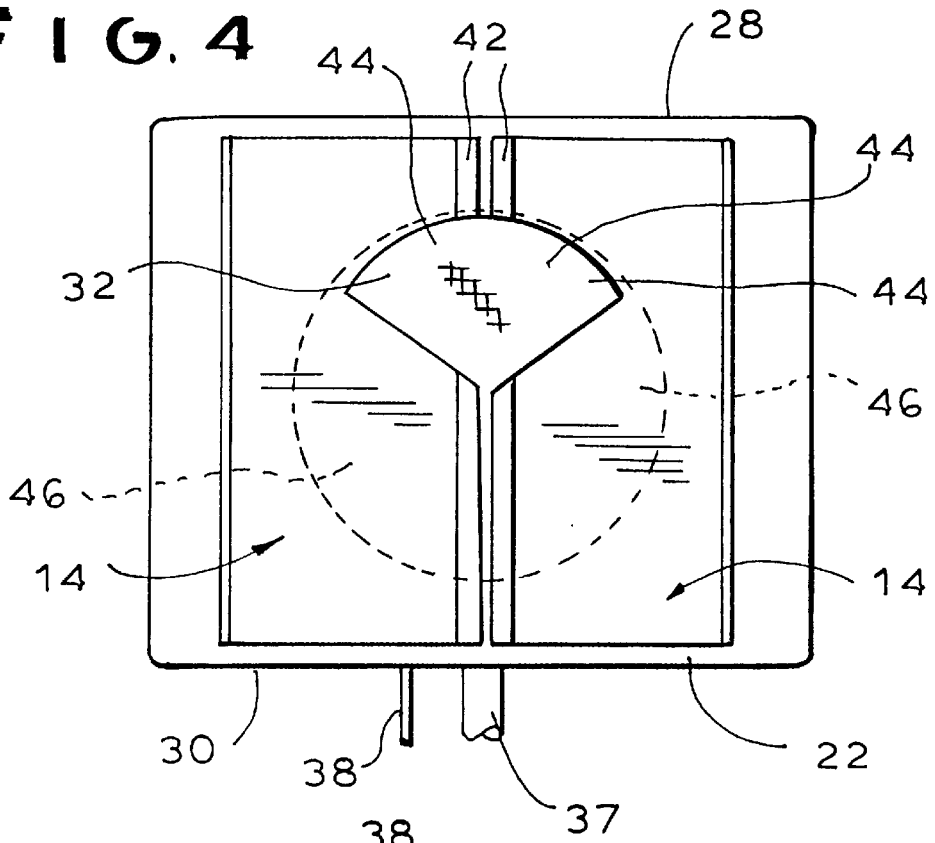
FIG. 4 is a front elevational view of a speaker with the reflectors in a reflecting orientation, midway between the non-reflecting and blocking orientations.
Figure 5:
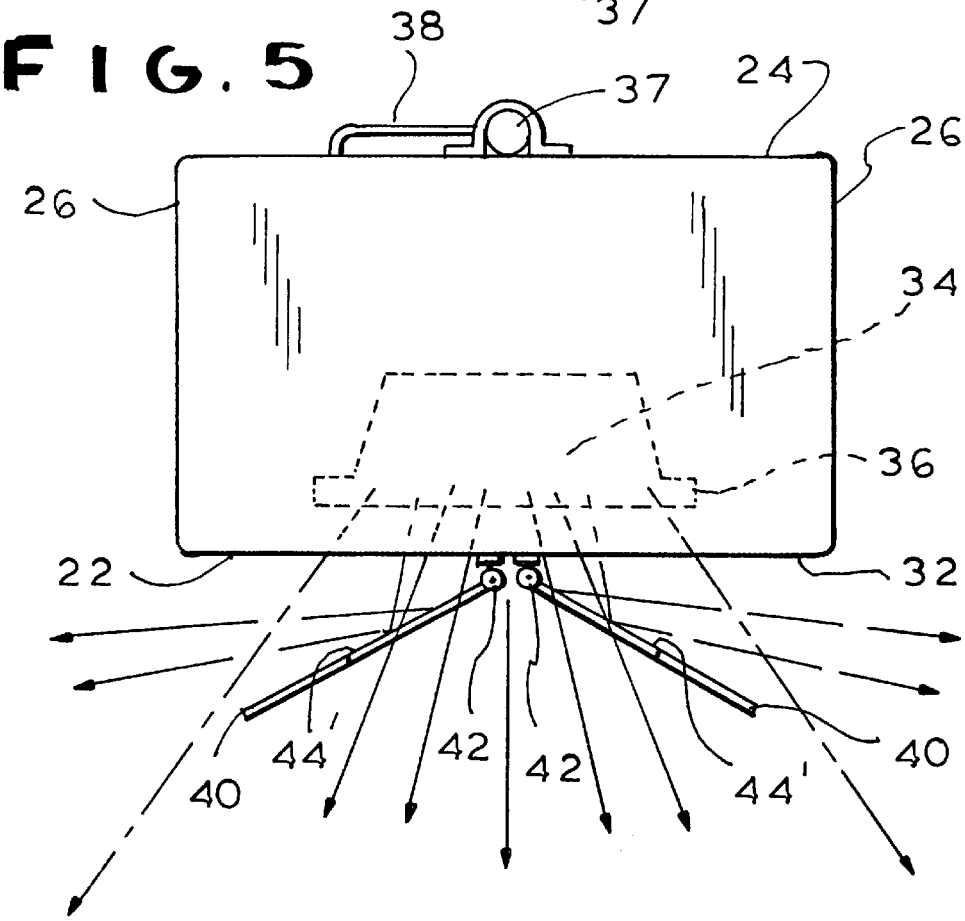
FIG. 5 is a top plan view thereof.
Figure 6:
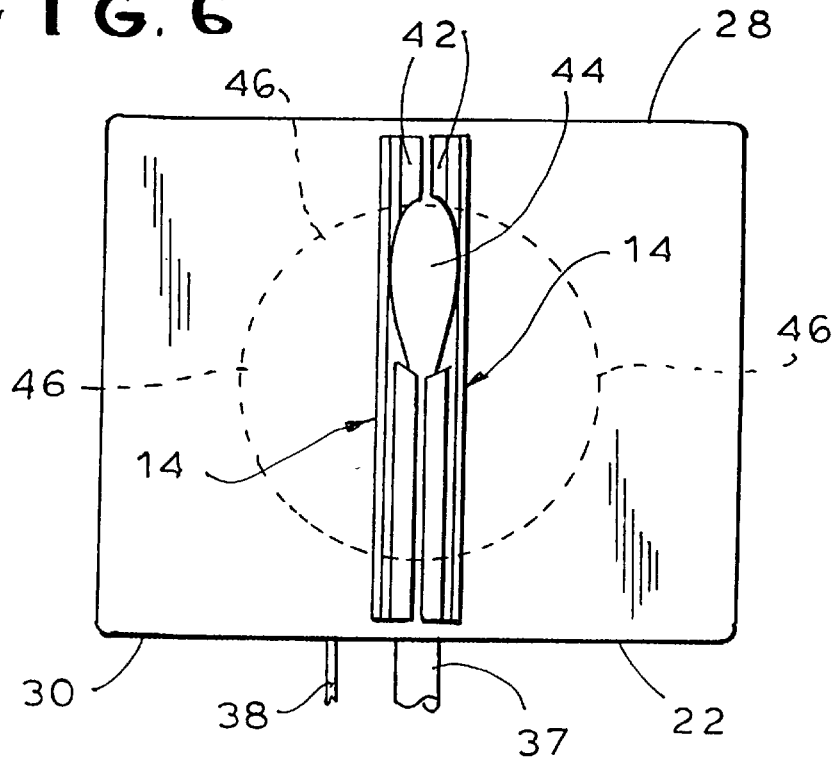
FIG. 6 is a front elevational view of a speaker with the reflectors in a blocking orientation.
Figure 7:
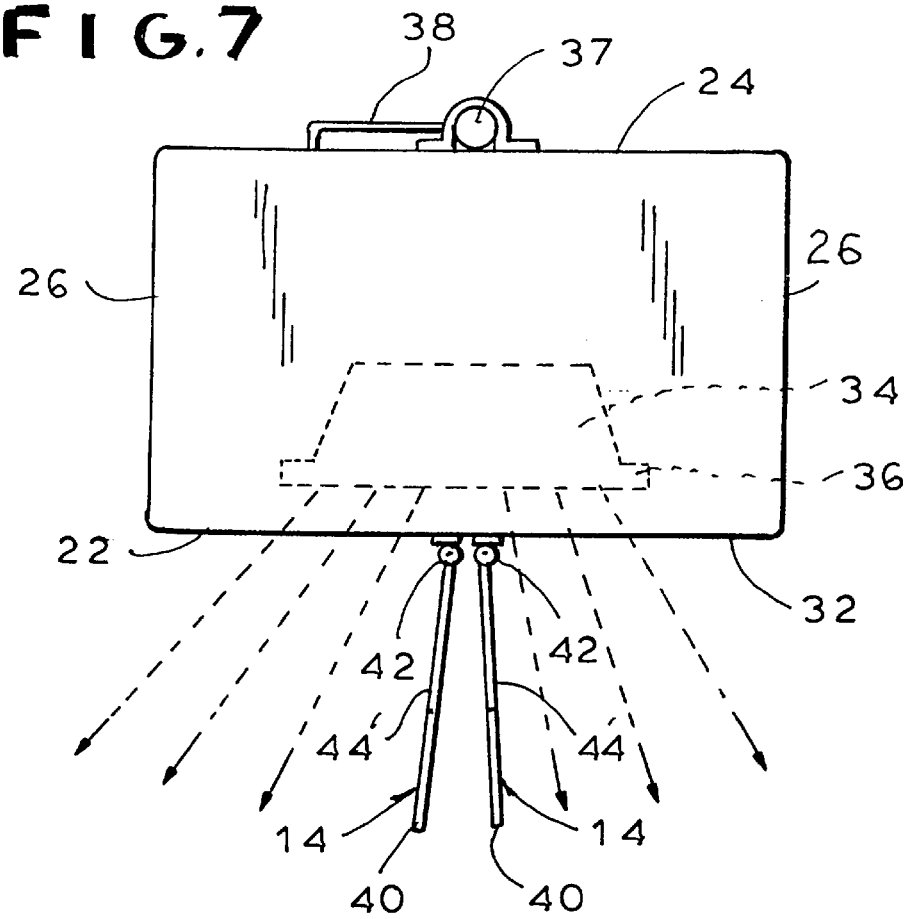
FIG. 7 is a top plan view thereof.

Each reflector 14 is pivotable relative to the forward facing acoustic outlet 36 between a non-reflecting orientation (as illustrated in FIGS. 6 and 7) wherein the sound-reflecting surface 40 is substantially in alignment with the forward direction (although each may extend slightly outwardly as well as forwardly—e.g., in a narrow "V" shape), and a reflecting orientation (as illustrated in FIGS. 4 and 5) wherein the sound-reflecting surface 40 is substantially angled to the forward direction—e.g., each angled at least 10° to the forward direction. When the sound-reflecting rearward facing surface 40 is in the non-reflecting orientation (i.e., substantially in alignment with the forward direction), it only minimally reflects sound emanating from the forward facing acoustic outlet 36. When the reflector 14 is in the reflecting orientation (i.e., the sound-reflecting rearward facing surface is substantially angled to the forward direction), it reflects impinging sound emanating from the forward facing acoustic outlet 36 laterally to a respective side. (See FIG. 5, where a pair of such reflectors 14 reflect impinging sound laterally to both sides thereof.) Preferably in the reflecting orientation the sound-reflecting rearward facing surface 40 is substantially angled outwardly to the forward direction (e.g., preferably at 45°), thereby to reflect impinging sound emanating from the forward facing acoustic outlet 36 laterally to a respective side.

As illustrated in FIGS. 2 and 3, each reflector 14 is preferably also pivotable relative to the forward facing acoustic outlet 36 to and from a blocking orientation wherein the sound-reflecting rearward facing surface 40 is generally parallel to the forward facing acoustic outlet 36, thereby to impede sound emanating from an area of the outlet therebehind and at the same time protect the aligned area of the outlet therebehind.

As best seen in FIG. 3, wherein the reflectors 14 are shown in the blocking orientation (i.e., parallel to the forward facing acoustic outlet 36), the reflectors 14 cooperatively define a joint sound-transmitting top portion 44 extending about 120° bilaterally of a central vertical axis substantially through the center of the forward facing acoustic outlet 36 and two sound-reflecting bottom portions 46, each bottom portion 46 extending about 120° on a respective side of the respective central vertical axis. The joint sound-transmitting top portion 44 covers about the top third of the reflectors 14 (and thus about a third of the front of the acoustic outlet 36), and each of the sound-reflecting bottom portions 46 cover about a respective bottom two-thirds of the reflector 14 (and hence about the bottom two-thirds of the front of the acoustic outlet 36). Thus each reflector 14 has a sound-transmitting top portion 44' occupying about the top third thereof and a sound-reflecting bottom portion 46 covering about a respective bottom two-thirds of the reflector 14. The reflector top portion 44' is generally pie-shaped (that is, triangular) and substantially disposed higher than the reflector bottom portion 46 (which is also a triangular pie-shape). The reflector portions—that is, the joint sound-transmitting top portion 44 formed by the two reflectors 14 and each of the two sound-reflecting bottom portions 46 formed by each reflector 14 (one sound-reflecting bottom portion 46 per reflector 14)—are of generally equal area.

It will be appreciated that the reflectors 14 in effect divide the speaker output (i.e., the moving element of the speaker or of any horn opening extended in front of the moving element) into three equal parts. This is achieved by the joint "pie-shaped" cut-out or sound-transmissive mesh top portion 44 of the reflectors 14 being centered equally so that the joint (formed by one top portion 44' in each of the left and right reflectors 14) does not reflectively cover the area in front of the top one-third of the acoustic outlet 36 (whether it is the speaker or a horn output area).

The arc occupied by each reflector occupies 120° (or one-third) of an imaginary circle placed directly in front of the acoustic outlet 36 and centered on the moving cone or cones (if a coaxial type of speaker, with separate woofer/mid-range/tweeter elements is used) or centered on the output opening (if a horn-type speaker is used). The top 120° of the imaginary circle in front of the acoustic outlet 36 is not covered by a sound-reflecting surface of either reflector 14, even when the reflectors are positioned at 90° to the forward plane of the acoustic outlet (i.e., in the blocking orientation). Accordingly, the sound from the top one-third of the speaker 34 is allowed to directly radiate into the listening area unhindered.

The top reflector portions 44' may be of cut-away (such that there is no material in the designated top portion) or may have existence as a sound-transmitting material, such as the conventional sound-transmitting mesh used in speakers.

The bottom reflector portions 46 are preferably left and right bottom reflector portions 46, and the left and right bottom reflector portions 46 reflect impinging sound toward the left and right, respectively, of the forward facing acoustic outlet 36. Preferably the sound-reflecting area 40 of the reflector 14 on the left is situated in front of the lower left portion of the acoustic outlet 36 and occupies an arc from the bottom of the cone area in a clockwise direction to a point 120° from this bottom of the cone area. The sound-reflecting area 40 of the reflector 14 on the right is situated in front of the lower right portion of the acoustic outlet 36 and occupies an arc from the bottom of the cone area in a counter-clockwise direction to a point 120° from this bottom of the cone area.

Preferably the reflectors 14 are independently pivotable so that the system 10 can be custom tuned to the geometry of a particular listening location. Preferably each reflector 14 is hinged on its respective vertical pivot axis 42 adjacent the centerline of the acoustic outlet 36 such that each reflector 14 can be moved, independently of the other, to any position from 0° (that is, directly in the forward direction) to 90° (that is, perpendicular to the forward direction) relative to the vertical face of the moving element of the acoustic outlet 36. It will be appreciated, however, that for particular applications the reflectors 14 may not be independently pivotable and the movement of one reflector 14 to a desired orientation may also cause a similar movement of the other reflector 14 to a corresponding opposite orientation.

In operation of the system 10, the extreme orientations of the reflectors 14 produce predictable results.

When the reflectors 14 are in the blocking orientation of FIGS. 2 and 3, only the sound emanating from the top one-third of the acoustic outlet 36 passes through the reflectors 14 (either through a cutout or sound-transmitting top portion 44 thereof) in order to reach the listener. When the reflectors 14 are in the blocking orientation substantially parallel to the forward direction in which the sound is directed, the top two-thirds of the reflectors 14 do not hamper transmission of the sounds from the acoustic outlet 36 to the listener (except for the possible modest reduction in sound resulting from the thickness of the reflector or reflectors 14 immediately in front of the vertical centerline pivot axis 42 of the acoustic outlet 36).

When the reflectors 14 are disposed in the non-reflecting orientation of FIGS. 6 and 7, thereby to define a narrow "V" aperture in front of the acoustic outlet 36, the sound emanating from the acoustic outlet 36 is projected a long distance, because the configuration of the reflectors 14 provides an acoustic lens over the bottom two-thirds of the acoustic outlet 36 such that the mid and high frequencies are concentrated by the reflectors into a tight, uniform, narrow beam. More particularly, the narrow "V" configuration for the pair of reflectors 14 provides an acoustic lens to concentrate, align (e.g., phase align) and provide a uniform path for the higher frequencies when forward projection is needed (e.g., in order to go from one end of a long room to the other end).

On the other hand, when the reflectors 14 are in the reflecting orientation of FIGS. 4 and 5 (e.g., as illustrated an orientation making an angle of 45° with the vertical plane of the speaker cone), it has been found that the sound pressure waves produced by the moving element of the speaker 34 will come into contact with, and be reflected from, the sound-reflecting surface 40 thereof at a complimentary angle. In this way, the sound dispersion from a typical speaker 34 can be made to produce the full frequency of sound in an output pattern that is variable from 30° off-axis to more than 180° off-axis. To the listener, this wide dispersion allows every position within a given listening environment to be effectively within a "sweet spot" in front of the acoustic outlet 36 and to receive the full frequency of the sound being produced.

In most instances the audience is located in front of the acoustic outlet so that any dispersion of the sound over 180° or more would be unnecessary. The ability to provide more than 180° of dispersion can be utilized, however, to produce "side fill" or monitoring of the sound mix for the performer. As most microphones used for public address have the ability to cancel sounds emanating from the rear or sides of the microphone, little or no increase in feedback occurs.

To recount, the top central third of the acoustic outlet propagates sound waves directly into the listening area unhindered, while the lower left and right thirds of the output of the acoustic outlet is reflected by a respective reflector at a complimentary angle (to the right and left, respectively) off axis to the plane of the acoustic outlet, the angle being controlled by the orientation of the reflectors relative to the forward plane of the output of the speaker.

Preferably the reflector is made of a suitable hard substance (such a plastic, metal, wood, etc.) that provides at least partial protection for the moving element of the acoustic outlet while in transit when the reflector is adjusted to a blocking orientation (that is, 90° to the output plane of the speaker) so that it provides a barrier between at least a part of the moving element of the acoustic outlet 36 and the external environment.

The sound dispersion from the speaker system can be adjusted to produce the full frequency of sound in an output pattern that is variable from 30° off axis to more than 180°. To the listener, this wide dispersion allows every position within a given listening environment to be technically in front of the speaker so that the listener receives the full frequency of the sound being produced. In most cases, the audience is located in front of the speaker so that any dispersion over 180° or so would not be necessary. Nonetheless, the ability to provide more than 180° of dispersion may be utilized to produce "side fill" or monitoring of the sound mix for the performer.

If there is a need to project the sound a long distance—e.g., from one end of a long room to the other end—the reflectors can be brought together to a relatively closed orientation in front of the speaker, facing forwardly and outwardly. In this position, the reflectors provide an acoustic lens wherein the middle and high frequencies are concentrated by the reflectors in a tight, uniform and narrow beam, as previously described. On the other hand, if there is a need to project the sound from one long wall of a narrow room to the other long wall, the reflectors can be extended apart in front of the speaker to a relatively open orientation. For example, if each reflector is placed in a mid-open position (45° away from the vertical plane of the speaker cone), the sound pressure waves produced by the moving element of the speaker will come into contact with and be reflected from the back side of the reflector at a complementary angle. In this way, the sound dispersion from a typical speaker can be made to produce the full frequency of sound in an output pattern that is variable to 180° or more. To the listener, this wide dispersion allows every position within a given listening environment to be technically in front of the speaker and to receive the full frequency of the sound being produced.

When the reflectors are disposed in the fully open or blocking orientation, they are parallel to and at least partially cover (block) the acoustic outlet of the speaker to protect the same, for example, during transport. Clearly the protection is less than 100% since typically the top third of each reflector is either cut-away or formed of a relatively insubstantial material such as a mesh.

To summarize, the present invention provides an adjustable speaker system, and the preferred embodiment incorporates an adjustable reflector to reflect impinging sounds. The system preferably has two adjustable reflectors, with the independently adjustable reflectors redirecting impinging sound laterally to both respective sides. Further, the system is inexpensive to manufacture, use and maintain.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. An adjustable speaker system comprising:

(A) a speaker enclosure having at least a forward facing surface said speaker enclosure enclosing a speaker with a forward facing acoustic outlet from which sound may emanate in a forward direction; and (B) a pair of reflectors with a sound-reflecting rearward facing surface, each reflector being pivotably secured adjacent said forward facing acoustic outlet and pivotable relative to said forward facing acoustic outlet between a non-reflecting orientation wherein said sound-reflecting rearward facing surface is substantially in alignment with said forward direction, thereby to only minimally reflect sound emanating from said forward facing acoustic outlet, and a reflecting orientation wherein said sound-reflecting rearward facing surface is substantially angled to said forward direction, thereby to reflect impinging sound emanating from said forward facing acoustic outlet laterally to a respective side; said reflectors, when parallel to said forward facing acoustic outlet, cooperatively define a sound-transmitting portion extending bilaterally of a central vertical axis substantially through the center of said forward facing acoustic outlet.

2. The system of claim 1 wherein said reflector portions are of generally equal area.

3. The system of claim 1 wherein said reflector top portion is generally pie-shaped.

4. The system of claim 1 wherein said reflectors are independently pivotable.

5. The system of claim 1 wherein said reflectors cooperatively define a sound-transmitting top portion and two sound-reflecting bottom portions, said top portion extending bilaterally of said central vertical axis, and each said bottom portion extending on a respective side of said central vertical axis.

6. The system of claim 5 wherein said reflector top portion is substantially disposed higher than said reflector bottom portions.

7. The system of claim 5 wherein said bottom reflector portions are left and right bottom reflector portions, and said left and right bottom reflector portions reflect impinging sound towards the left and right, respectively, of said forward facing acoustic outlet.

8. The system of claim 5 wherein said sound-transmitting top portion extends about 120° bilaterally of said central vertical axis, and each said sound-reflecting bottom portion extends about 120° on a respective side of said central vertical axis.

9. The system of claim 8 wherein said top portion extends over the top third of said reflectors, and each said bottom portion extends over a respective two-thirds of said reflector.

10. An adjustable speaker system comprising:

(A) a speaker enclosure having at least a forward facing surface, said speaker enclosure enclosing a speaker with a forward facing acoustic outlet from which sound may emanate in a forward direction; and (B) a pair of reflectors with a sound-reflecting rearward facing surface, each reflector being pivotably secured adjacent and forwardly of said forward facing acoustic outlet for pivoting about a central vertical axis substantially through the center of said outlet, each reflector being pivotable relative to said forward facing acoustic outlet between a non-reflecting orientation wherein said sound-reflecting rearward facing surface is substantially in alignment with said forward direction, thereby to only minimally reflect sound emanating from said forward facing acoustic outlet, and a reflecting orientation wherein said sound-reflecting rearward facing surface is substantially angled to said forward direction, thereby to reflect impinging sound emanating from said outlet laterally to a respective side, and a blocking orientation wherein said sound-reflecting rearward facing surface is generally parallel to said outlet, thereby to impede sound emanating from an area of said outlet therebehind; in said reflecting orientation, said sound-reflecting rearward facing surface being angled outwardly to said forward direction, thereby to reflect impinging sound emanating from said forward facing acoustic outlet laterally to a respective side.

11. The system of claim 10 including an independently pivotable pair of said reflectors, said reflectors, when parallel to said forward facing acoustic outlet, cooperatively defining a sound-transmitting top portion extending about 120° bilaterally of the central vertical axis substantially through the center of said forward facing acoustic outlet over about the top third of said reflectors, and two sound-reflecting bottom portions, each said bottom portion extending about 120° on a respective side of said central vertical axis over about a respective bottom two-thirds of said reflector; said reflector top portion being generally pie-shaped and generally disposed higher than said reflector bottom portions, said reflector portions being of generally equal area, said bottom reflector portions being left and right bottom reflector portions, and said left and right bottom reflector portions reflecting impinging sound towards the left and right, respectively, of said forward facing acoustic outlet.

* * * * *